United States Patent [19]

Pipasik

[11] Patent Number: 4,817,943

[45] Date of Patent: Apr. 4, 1989

[54] TOTAL SHOULDER EXERCISE AND MUSCLE DEVELOPMENT MACHINE

[76] Inventor: George Pipasik, 954 14th St., Apt. A, Santa Monica, Calif. 90403

[21] Appl. No.: 87,591

[22] Filed: Aug. 20, 1987

[51] Int. Cl.[4] ..... A63B 21/06

[52] U.S. Cl. ..... 272/117; 272/134

[58] Field of Search ..... 272/117, 118, 123, 134, 272/144, DIG. 4

[56] References Cited

U.S. PATENT DOCUMENTS

| | | | |
|---|---|---|---|
| 3,640,527 | 2/1972 | Proctor | 272/118 |
| 3,708,166 | 1/1973 | Annas | 272/118 X |
| 4,226,415 | 10/1980 | Wright | 272/134 X |
| 4,254,950 | 3/1981 | Baumann | 272/134 X |
| 4,296,924 | 10/1981 | Anzaldua et al. | 272/117 |
| 4,319,747 | 3/1982 | Rodgers | 272/117 |
| 4,405,128 | 9/1983 | McLaughlin et al. | 272/117 |
| 4,482,152 | 11/1984 | Wolff | 272/134 X |
| 4,586,510 | 5/1986 | Glaser et al. | 272/117 X |
| 4,603,855 | 8/1986 | Sebelle | 272/117 |
| 4,611,807 | 9/1986 | Castillo | 272/DIG. 4 X |

FOREIGN PATENT DOCUMENTS

| | | | |
|---|---|---|---|
| 2524468 | 12/1976 | Fed. Rep. of Germany | 272/144 |
| 8501446 | 4/1985 | World Int. Prop. O. | 272/134 |

*Primary Examiner*—Richard J. Apley

*Assistant Examiner*—Robert W. Bahr

*Attorney, Agent, or Firm*—Philip D. Junkins

[57] ABSTRACT

An exercise machine for the strengthening and development of shoulder muscles of an exercising person. The machine has a structural frame including a centrally-disposed upright body support beam with such beam bearing an adjustable height seat adapted to support the exercising person in a sitting position. Right side and left side arm abutment members are positioned for engagement by the forearms, in horizontal orientation, of the exercising person, such abutment members each being affixed to a supporting frame journaled to a journal box affixed to the upper end of the body support beam and located at a point above a shoulder of the exercising person whereby the arm abutment members may each be rotated outwardly and upwardly by movement of the upper arm of such person. Weights are carried by the supporting frame of each abutment member at the rearward end thereof and are adjustably positioned on such frame with respect to its pivot point at its respective journal box whereby a varible resistive force for strengthening and developing shoulder muscles is applied through the supporting frame and abutment member to the forearm of the exercising person in opposition to the rotative movement of the upper arm of such person in an outward and upward direction.

14 Claims, 3 Drawing Sheets

TOTAL SHOULDER EXERCISE AND MUSCLE DEVELOPMENT MACHINE

FIELD OF THE INVENTION

The present invention relates to physical exercise machines. More particularly, the invention concerns physical exercise machines designed and operated for the development of shoulder muscles.

BACKGROUND OF THE INVENTION

The skeletal-muscular system of the human body consists of the 206 bones and over 650 muscles that maintain the skeletal structure, protect and support the internal organs, and help the body move. During recent years a great deal of interest has been shown in the exercise of important body muscles for the development of specific strengths and physical abilities and for the development of desired body shapes and proportions. Particular attention has been devoted to the development of the chest muscles (pectoralis major), back muscles (trapezius), upper arm muscles (biceps and triceps) and principal upper leg muscles (quadriceps femoris) through weight lift and force application and resistance exercise programs and machines. Amateur and professional athletes and body builders, both male and female alike, spend many hours per week in such exercise programs utilizing a broad range of apparatus from simple barbells to complex and sophisticated exercise machines. Although many of the body building exercise programs include, to some degree, development of shoulder muscles, no specific machine has heretofore been designed to provide a total exercise system for shoulder muscle development.

The human shoulder consists of two bones: (1) a broad, flat shoulder blade (or scapula) in the back; and (2) a slender collar bone (or clavical) in front. The large bone of the upper arm (the humerous) has a round head-like portion that fits into a shallow depression of the scapula, to form a ball-and-socket joint, which allows great freedom of movement. Seventeen muscles serve to move and cover the joint, including (principally) the deltoid muscle, upper portions of the pectoralis major, biceps and triceps muscles, and lower portion of the trapezius muscle. The shoulder joint, because of its great mobility, is the most frequently dislocated joint of the human body. The clavicle bone, lying very close to the body surface, is one of the bones most frequently fractured during athletic activities.

OBJECTS OF THE INVENTION

It is therefore a principal object of the present invention to provide a total shoulder exercise machine for the strengthening and development of shoulder muscles.

It is another object of the invention to provide an exercise machine which is capable of being used by men and women of varying body size and structure in a safe and reliable manner to build up shoulder muscle strength.

It is a further object of the invention to provide a total shoulder muscle exercise machine which allows the user to vary the resistance force exerted by the device and which is readily adjustable for use by persons of all sizes.

It is a still further object of the invention to provide a total shoulder exercise machine for the strengthening and development of shoulder muscles with the user positioned in a sitting position with back support.

Other objects, features and advantages of the invention will be apparent from the following summary and detailed description of the invention, taken in conjunction with the accompanying drawing figures.

SUMMARY OF THE INVENTION

The present invention relates to a total shoulder exercise machine for use by an individual (man, woman or child, amateur or professional athlete or body builder) to strengthen and develop the shoulder muscles. The machine has as its principal structural assembly a sturdy and rigid framework comprised of: (a) an elongated, longitudinally-extending primary base beam; (b) a laterally-extending secondary base beam connected at its mid-point to the rearward end of the primary base beam; (c) parallel, vertical beams affixed to, and extending upwardly from, the secondary base beam, each vertical beam supporting at its upper end a forwardly-projecting support arm terminating in a journal box; and (d) transverse brace members for maintaining parallelism between the vertical beams and between the support arms of the framework.

A body support beam of extensible length is pivoted, by laterally-extending journals at its upper portion, to the journal boxes of the support arms and is adjustably affixed at its lower end to the primary base beam whereby such body support beam at its lower end may be positioned forwardly or rearwardly along the primary base beam to provide a vertical orientation to such support beam or a variety of angular orientations to such beam with respect to vertical. The body support beam bears an adjustable-height seat adapted to support an exercising person in a sitting position with respect to the shoulder exercise machine. Such beam also bears a back rest for the exercising person.

Affixed to the upper end of the body support beam is a transverse beam. This beam has journaled to each end thereof right and left side pivotable lower arm abutment members. Each abutment member has associated therewith forwardly positioned handgrips and rearwardly positioned adjustable weight loading means for applying variable resistive force to the exercise machine user's upper arm and shoulder muscles (via the abutment members) as the user rotates his or her arms upwardly and outwardly against such force while extending the forearms and hands to the handgrips. During use of the total shoulder muscle exercise machine the user repeatedly rotates his or her upper arms approximately 90°, against the applied resistive force of the abutment members, to a position whereat the upper arms are in substantially horizontal orientation with respect to the user's shoulders and thereafter returns the upper arms (through approximately 90° of reverse rotation) to their downward at rest position adjacent the user's body (trunk portion). An appropriate shoulder muscle strengthening and development program using the exercise machine of the present invention, includes a regimen of increasing arm movement resistive force by the adjustable weight loading means associated with the pivotable lower arm abutment members.

BRIEF DESCRIPTION OF THE DRAWING FIGURES

The above and other features and advantages of the invention are illustrated in the accompanying drawing figures in which:

FIG. 1 is a side elevation view of the total shoulder exercise machine of the invention showing, particularly, the principal components of the machine's frame, body seat and back rest arrangements, and the right arm force-applying abutment member, with a seated exercise machine user shown in phantom;

FIG. 2 is a front elevation view of the exercise machine of the invention, taken along the plane of line 2—2 of FIG. 3, showing, particularly, the pivoted side arm abutment members against which the user rotates, outwardly and upwardly, his or her upper arms in opposition to the adjustable resisting forces applied by such abutment members of the machine to the user's forearms; and FIG. 3 is a top plan view of the exercise machine of the invention showing, particularly, the arrangement of pivoted side force-applying arm abutment members of the machine and the adjustable weight system for varying the resistance forces applied to the user's forearms by such abutment members.

DETAILED DESCRIPTION OF THE INVENTION

Figure 1:
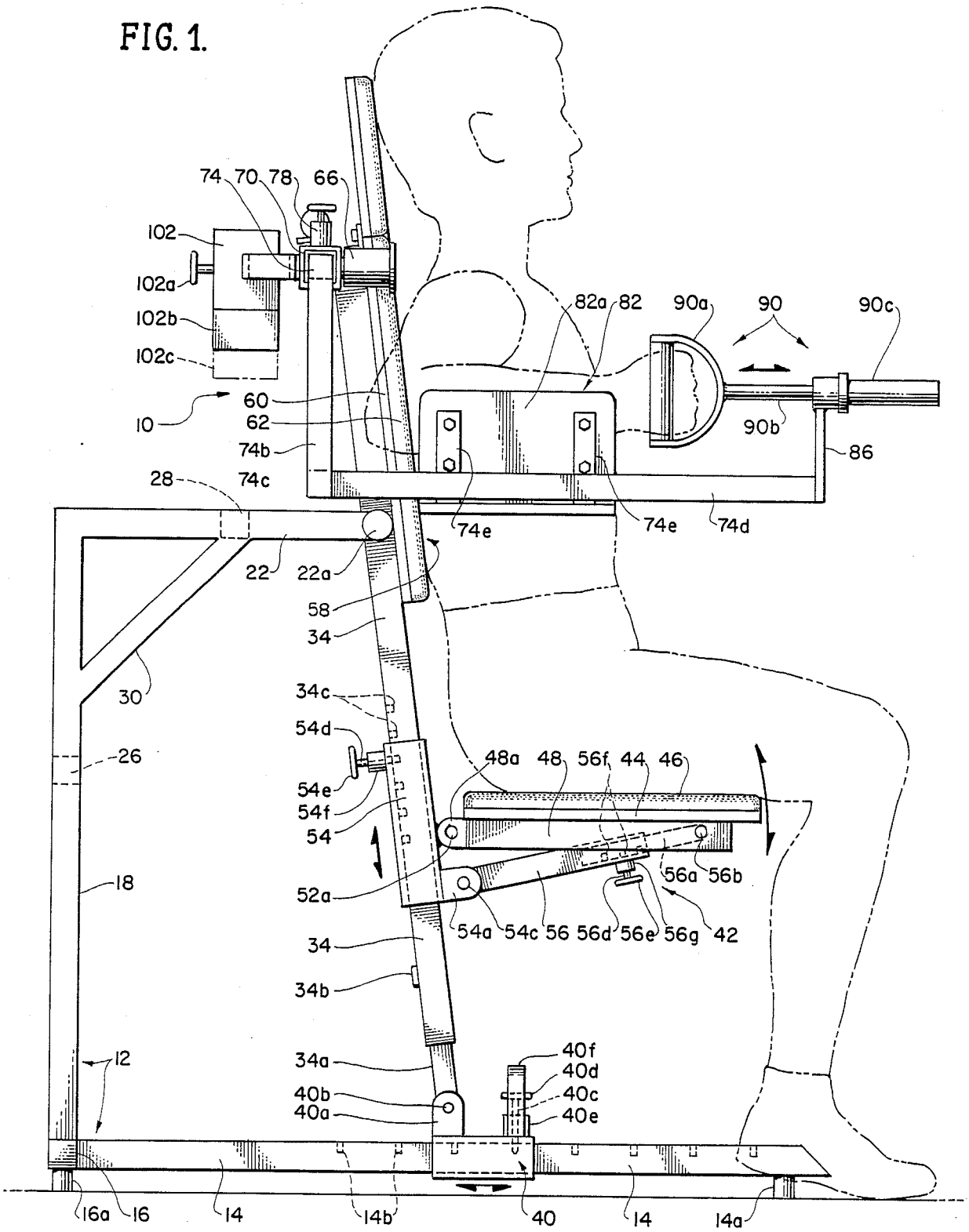
Figure 2:
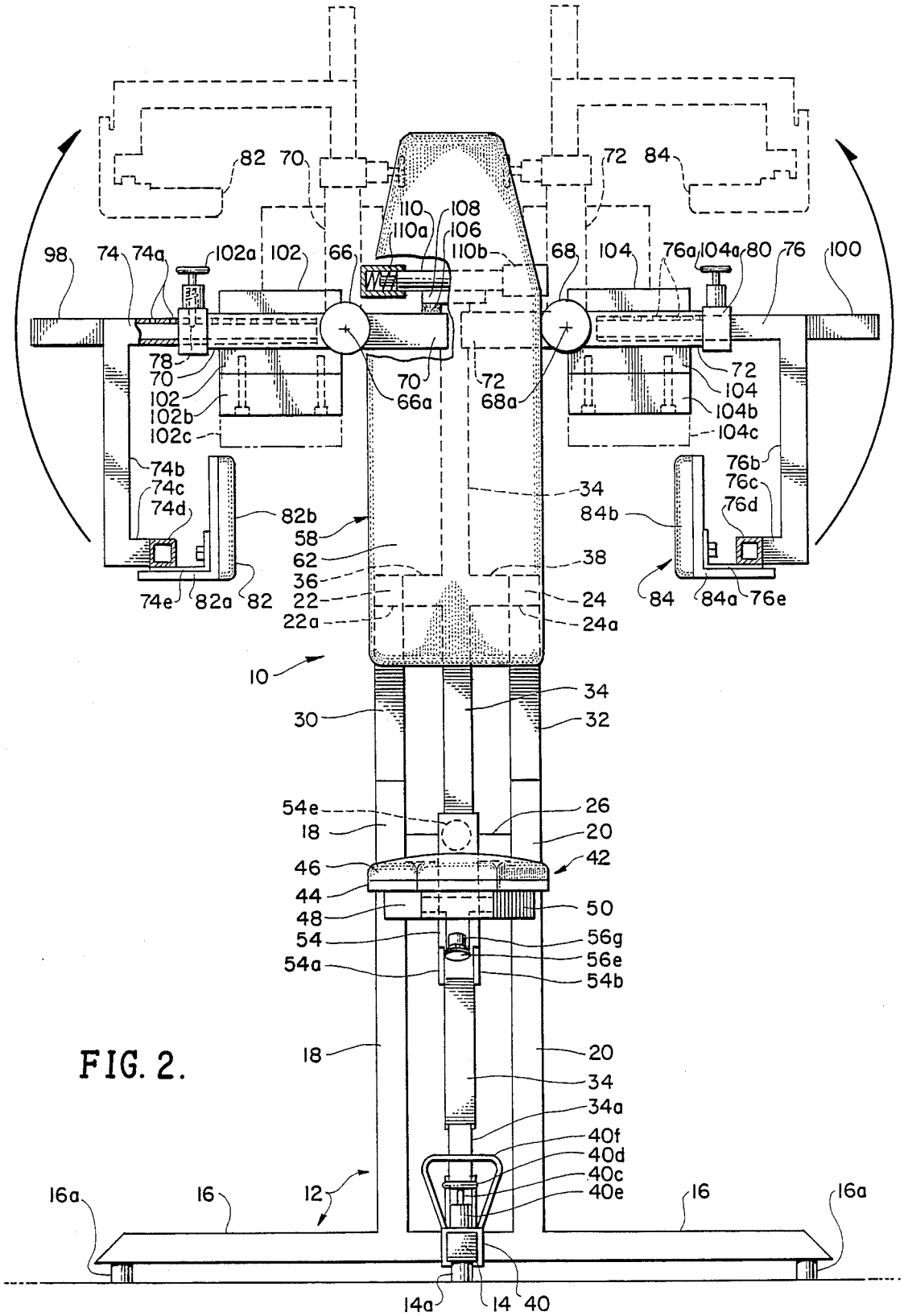
Figure 3:
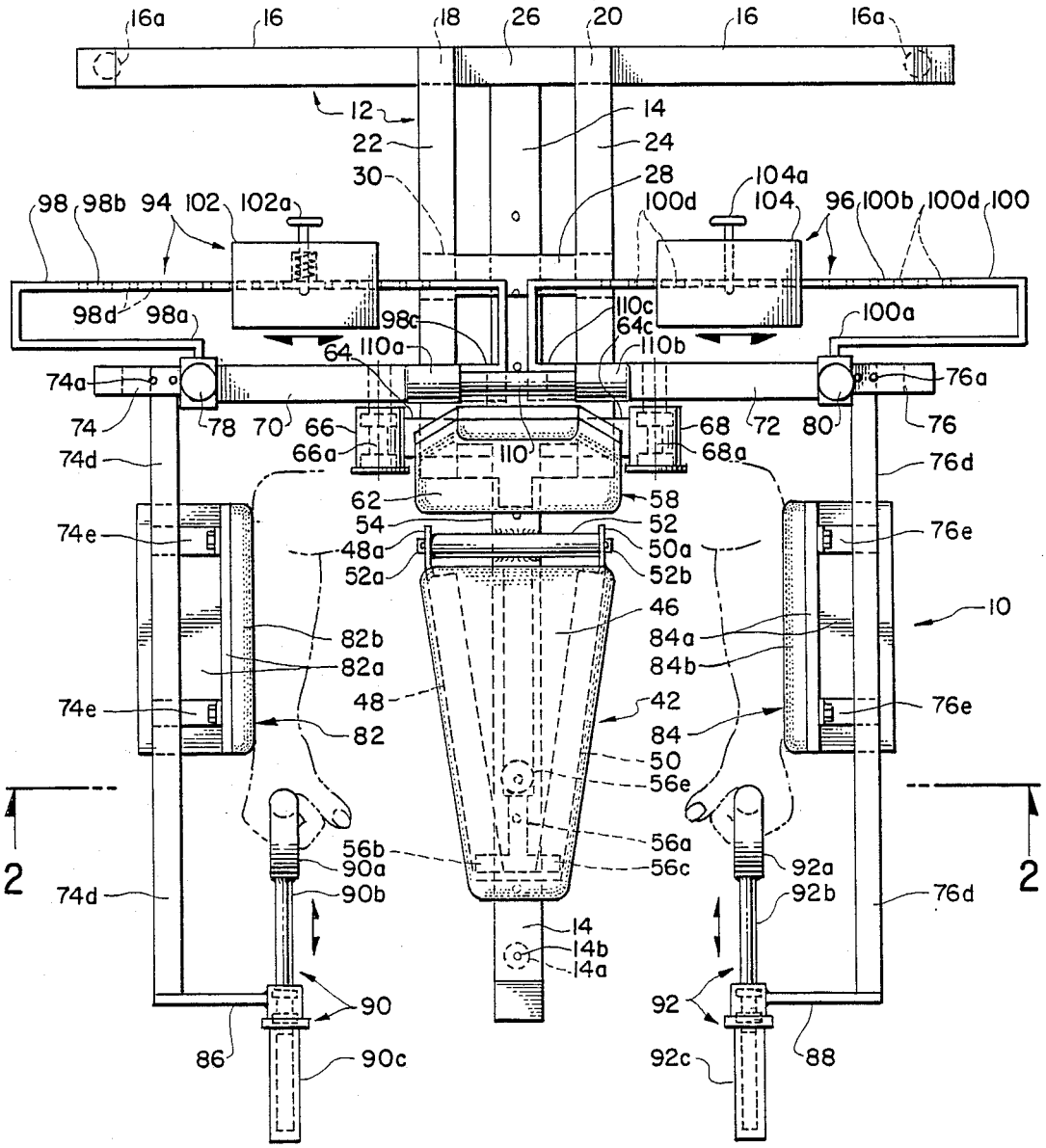

A preferred embodiment of the total shoulder exercise machine of the invention is shown in FIGS. 1 through 3 on the drawing sheets. The machine, generally indicated by the numeral 10, has as its principal structural assembly a sturdy and rigid framework 12 comprised of: (a) an elongated,longitudinally-extending primary base beam 14; (b) a laterally-extending secondary base beam 16 connected at its mid-point to the rearward end of the primary base beam; (c) parallel, vertical beams 18 and 20 affixed to, and extending upwardly from, the secondary base beam, each vertically-extending beam 18 and 20 supporting at its upper end a forwardly-projecting, horizontal support arm 22 and 24, respectively, terminating in a journal box 22*a* and 24*a*, respectively; and (d) appropriate transverse brace members 26 and 28 for maintaining parallelism between the spaced vertical beams 18 and 20 and between the spaced support arms 22 and 24 of the framework structure 12. The primary base beam 14 and secondary base beam 16 are appropriately supported at a slight distance above floor surfaces by beam lugs 14*a* and 16*a*, respectively. The framework structure is also provided with angular oriented brace members 30 and 32 extending, respectively, between vertical beam 18 and support arm 22 and between vertical beam 20 and support arm 24 to solidly maintain such support arms in their respective upper horizontal, forwardly-projecting orientation.

A body support beam 34 of extensible length is pivoted, by laterally-extending journals 36 and 38 at its upper portion, to the journal boxes 22*a* and 24*a*, respectively, of the support arms 22 and 24. The length of body support beam 34 is made extensible at its lower end by telescoping leg portion 34*a*. The leg portion 34*a* of the body support beam 34 is pivotally attached at its lower end to a beam angulation adjustment member 40 which is slidably mounted on and about the longitudinally-extending primary base beam 14. The slidable adjustment member 40 is provided with pivot bracket 40*a* for pivotal connection (via pivot axle 40*b*) to telescoping leg 34*a*. The adjustment member 40 is also provided with a lock pin 40*c* (having a pin lifter handle 40*d*) which extends through spring casing 40*e* with the lock pin 40*c* (in known manner) being spring biased to seat in one of the series of lock holes 14*b* located along the top of primary base beam 14. With the lock pin 40*c* pulled upwardly from its locking position, the slidable beam angulation adjustment member 40 may be moved forwardly or rearwardly along the primary base beam 14 by handle 40*f* whereby the body support beam 34 at its lower end is positioned forwardly or rearwardly to provide a desired vertical orientation to such support beam or to provide a variety of angular orientation settings to such beam with respect to vertical.

The body support beam 34 bears an adjustable-height seat, generally indicated by the numeral 42. The seat structure 42 is comprised of a seat platform 44 to which is applied an appropriate amount of padding 46 (for user comfort) which may be of a foam plastic or rubber material (with high original shape memory) covered by an impervious sheet fabric material. The seat platform 44 is affixed to a seat frame comprised of frame members 48 and 50 which are pivotally connected at their respective inboard end portions 48*a* and 50*a* to the ends of a seat pivot member 52 (see particularly FIG. 3) affixed to seat height adjustment member 54 (see particularly FIG. 1) which is slidably mounted on and about body support beam 34. The pivot member 52 may be welded to the front surface of the seat height adjustment member 54 and has extending from each end thereof pivot axles 52*a* and 52*b* which pivotally extend through the end portions 48*a* and 50*a*, respectively, of frame members 48 and 50. Such end portions of frame members 48 and 50 may be maintained in pivotal relationship with seat pivot member 52 by cotter pins or other appropriate means. The seat assembly 42 and its frame members 48 and 50 are further supported in a generally horizontal orientation by extensible (adjustable) seat prop arm 56 which is pivoted to seat height adjustment member 54 by pivot brackets 54*a* and 54*b* mounted on member 54. The prop arm 56 pivots about axle 54*c* supported in brackets 54*a* and 54*b*. The length of seat prop arm 56 is made extensible at its forward end by telescoping arm portion 56*a*. The telescoping arm portion 56*a* of arm 56 is pivotally attached at its end to the inside forward ends of seat frame members 48 and 50 by journal arms 56*b* and 56*c*. The position of telescoping arm portion 56*a* within prop arm 56 (and thus the position of seat assembly 42 with respect to horizontal is determined by a lock pin 56*d* (having puller handle 56*e*) which extends through the wall of arm 56 to seat in one of the series of lock holes 56*f* in telescoping arm portion 56*a*. The lock pin 56*d* also extends through a spring casing 56*g* (mounted on prop arm 56) with such pin (in known manner) being spring biased to its seated (locked) position in one of the lock holes 56*f*. With the lock pin 56*d* pulled downwardly from its locked position (against the spring bias), the pivotable seat assembly 42 may be adjusted to a desired horizontal orientation after determination of the position of beam angulation adjustment member 40 and the resultant angulation of body support beam 34 with respect to vertical.

The seat height adjustment member 54, slidably mounted on and about body support beam 34, is locked at an appropriate height for the individual exercise machine user by a lock pin 54*d* (having puller handle 54*e*) which extends through the wall of member 54 to seat in one of the series of lock holes 34*c* in body support beam 34. The lock pin 54*d* also extends through a spring casing 54*f* (mounted on seat height adjustment member 54) with such pin (in known manner) being spring biased to its seated (locked) position in one of the lock holes 34*c*. With the lock pin 54*d* pulled outwardly from its locking position (against the spring bias), the height adjustment member 54 (and its supported seat assembly 42) may be adjusted to a desired height along body support beam 34. The lock pin 54*d* is released to seat in one of the lock holes 34*c* when the proper seat height is established for the intended user. The body support beam 34 is provided with a lower stop member 34*b* which limits the lowest point to which the height adjustment member 54 may be lowered.

There is affixed to the upper portion of body support beam 34, a back rest and head support structure, generally indicated by the numeral 58. This structure is comprised of a back platform 60 to which there is applied an appropriate amount of padding 62, for user comfort and support which may be of a foam plastic or rubber material covered by an impervious sheet fabric material.

The upper end of body support beam 34 is provided with an affixed, relatively short cross beam 64 which extends laterally of beam 34 and has mounted on its outward ends journal boxes 66 and 68. Pivotally journaled to journal boxes 66 and 68 are hollow pivot arms 70 and 72, respectively. Each of such pivot arms includes a telescoping tubular arm extension member 74 and 76, respectively, which may be adjustably positioned inwardly and outwardly of its respective hollow arm and locked at an appropriate extended position by a locking pin mechanism 78 and 80, respectively, of the type 54*d* previously described with respect to the seat height adjustment member 54. The tubular arm extension members 74 and 76 are provided with a series of lock holes 74*a* and 76*a*, respectively, for receiving the lock pin, respectively, of locking mechanisms 78 and 80. After extending an appropriate transverse distance, each of the tubular extension members 74 and 76 extend downwardly in a tubular portion 74*b* and 76*b*, thence inwardly in a tubular portion 74*c* and 76*c* and finally in a forward portion 74*d* and 76*d*, respectively. Affixed to the underside of tubular portions 74*d* and 76*d*, at appropriate distance along such tubular portions, are brackets 74*e* and 76*e*, respectively. These brackets have affixed thereto and support elongated forearm abutment members, indicated generally by the numerals 82 and 84, respectively. The elongated forearm abutment members are comprised of angled abutment plates 82*a* and 84*a* affixed to brackets 74*e* and 76*e*, respectively, with an appropriate amount of padding 82*b* and 84*b* (foam plastic or rubber) covered by impervious sheet fabric material. As shown in FIG. 2, the arm abutment members 82 and 84 and their respective supporting structures pivot outwardly and upwardly about the pivot axes 66*a* and 68*a* of journal boxes 66 and 68, respectively, from their respective downward-projecting at rest positions to their upward-projecting resistive force-applying positions shown in phantom.

The forward ends of tubular portions 74*d* and 76*d* of the extension members 74 and 76, respectively, each bear an upwardly and inwardly extending bracket 86 and 88 (see particularly FIGS. 1 and 3) which each support a handgrip mechanism generally indicated by numerals 90 and 92, respectively, for grasping by the hands of the exercise machine user for the purposes of body support and alignment within the machine, forearm alignment with the respective arm abutment members and positioning of the user's shoulders to obtain maximum shoulder muscle exercise and development benefits from the machine. The handgrip mechanisms 90 and 92 are comprised of handgrips 90*a* and 92*a*, supporting rods 90*b* and 92*b*, and cylinders 90*c* and 92*c* for receiving the forward ends of rods 90*b* and 92*b* and applying a light forward spring bias to such rods (and their associated handgrips).

For applying variable resistive force to the exercise machine user's upper arm and shoulder muscles (via the forearm abutment members 82 and 84), as the user rotates his or her arms upwardly and outwardly, there is provided adjustable weight loading means at each rear side of the machine, indicated generally by the numerals 94 and 96, respectively. Each of such means is comprised of a looped weight bracket 98 and 100, respectively, and a positionable primary weight unit 102 and 104, respectively. The looped weight brackets are affixed at their outer loop ends 98*a* and 100*a* to locking pin mechanisms 78 and 80, respectively, and each extend across the rear of the exercise machine in straight loop portions 98*b* and 100*b*, respectively, and terminate at their inward loop ends 98*c* and 100*c* affixed to the inner ends, respectively, of pivot arms 70 and 72. The positionable weights 102 and 104 are mounted to their respective straight loop portions 98*b* and 100*b* of brackets 98 and 100. Each primary weight unit 102 and 104 has a spring biased lock pin and puller mechanism 102*a* and 104*a*, respectively, with the pin portion of such mechanisms projecting through one of the series of pin lock holes 98*d* and 100*d* located along straight loop portions 98*b* and 100*b* of brackets 98 and 100, respectively, to lock the weights in their appropriate position during use of the exercise machine. As shown in FIG. 2, additional weight units 102*b* and 104*b* and 102*c* and 104*c* may be added to primary weight units 102 and 104 of the total shoulder muscle exercise machine as the users training regime increases with respect to the application of resistive force to the arm and shoulder muscles.

It should be recalled that the pivot arms 70 and 72 rotate about journal axes 66*a* and 68*a*, respectively. Thus, the weight units 102 and 104 also rotate upwardly with respect to such axes from their positions as shown in FIG. 2. The pivot arms 70 and 72 each act as simple levers with axes 66*a* and 68*a* of the journal boxes 66 and 68 comprising fulcrum points and with the exercise machine user's forearm force applied outwardly and upwardly through abutment members 82 and 84 and tubular portions 74*b* and 76*b* to pivot arms (levers) 70 and 72 outboard of weights 102 and 104 applied to such arms. The forearm force (generated through upper arm movement) required for rotation of pivot arms 70 and 72 is also dependent upon the weight of the arm abutment members 82 and 84 (including their respective supporting framework) and the weight of the handgrip mechanisms 90 and 92, respectively. As the weights 102 and 104 are positioned outwardly on their respective supporting loop portions 98*b* and 100*b*, away from pivot axes 66*a* and 68*a*, the weight moment or resistive force (weight of variable weight plus apparatus weight times distance from pivot point or fulcrum) increases thereby increasing the force required to be applied by the exercise machine user's arm and shoulder muscles (via forearm pressure applied to the elongated forearm abutment members 82 and 84) to move the abutment members outwardly and upwardly. It will be noted that adjustable weights 102 and 104 may be moved inwardly on their supporting loop portions 98*b* and 100*b* to a point inboard of axes 66*a* and 68*a* of the journal boxes 66 and 68 to offset the weight of arm abutment members 82 and 84 (including their respective framework) and thereby decrease the force required to be applied by the user's arm and shoulder muscles (through the forearms) to move the abutment members outwardly and upwardly.

The rotatable pivot arms 70 and 72 (and their associated arm abutment apparatus and weight units) are maintained in their horizontal (at rest) orientation by cushion stops 106 (one of which is shown in FIG. 2 in an upper cut-away section of such figure) mounted on a stop bar 108 affixed to the upper end of body support beam 34. Also affixed to the upper end of the body support beam 34 is a pivot arm stop mechanism 110 which acts, through its spring biased end caps 110*a* and 110*b*, to cushion and stop the rotational movement of the pivot arms 70 and 72 as they reach their respective vertical orientation as shown in phantom outline in FIG. 2.

The exercise machine of the present invention, as described in detail hereinbefore, provides men, women and children of varying body size and structure with means for strengthening and developing the entire group of upper arm and shoulder muscles of their body in a safe and reliable manner. The machine is used by the exercising person in a comfortable sitting position as shown in FIG. 1—a machine user being shown in phantom outline. The machine is provided with a complete range of body size and body position adjustment features for accommodating the user. The user exercises his or her upper arm and shoulder muscles by simultaneously rotating the upper arms outwardly and upwardly over a prescribed number of cycles against like resistive forces applied to the forearms by forearm abutment members which are interconnected (as described above) to adjustable levered weight systems. As the user's shoulder muscles gain strength over the regime of daily machine use, the resistive force applied to the user's forearms is increased by shifting the weight units on each rear side of the machine outwardly away from the pivot or fulcrum point of the levered weight system to create a greater force moment (weight times the distance from the point of weight rotation). Thus, there is provided through the present invention a total shoulder exercise machine for use by an individual to strengthen and develop the shoulder muscles.

While the invention has been described in connection with a particular structural embodiment of a total shoulder exercise machine, many modifications of the apparatus will be apparent to those skilled in the art. Accordingly, such modifications are to be included within the spirit and scope of the invention as defined by the following claims.

What I claim is:

1. An exercise machine for the strengthening and development of shoulder muscles comprising:

(a) a frame including a longitudinally-extending base beam and an upper pair of horizontally-projecting support arms each terminating in a journal box;

(b) a centrally-disposed, extensible-length body support beam journaled in its upper portion to the journal boxes of said support arms for pivotal connection thereto and including means at its lower end for adjustable coupling to said base beam whereby the lower end of said body support beam may be positioned forwardly or rearwardly on said base beam to provide a desired vertical or off-vertical orientation to said body support beam;

(c) an adjustable height seat on said body support beam adapted to support an exercising person in a sitting position;

(d) right side and left side arm abutment members positioned for engagement by the forearms, in horizontal orientation, of the exercising person, said abutment members each being affixed to a supporting frame journaled to a journal box affixed to the upper end of said body support beam located at a point above a shoulder of the exercising person whereby said arm abutment members may each be rotated outwardly and upwardly by movement of the upper arm of said exercising person;

(e) handgrip means carried by the supporting frame of each abutment member at the forward end thereof and positioned for grasping engagement by the hands of the exercising person; and (f) weight means carried by the supporting frame of each abutment member at the rearward end thereof and adjustably positioned on said frame with respect to the pivot point of said frame whereby a variable resistive force for strengthening and developing shoulder muscles is applied through said frame and said abutment member to the forearm of said exercising person in opposition to rotative movement of the upper arm of said person in an outward and upward direction.

2. An exercise machine for the strengthening and development of shoulder muscles as claimed in claim 1 wherein the centrally-disposed, extensible-length body support beam includes at its lower end a telescoping leg portion terminating in a pivotal connection to the means for adjustable coupling of said body support beam to said base beam.

3. An exercise machine for the strengthening and development of shoulder muscles as claimed in claim 1 wherein the means for adjustable coupling of said body support beam to said base beam includes a pull-type lock pin which is spring biased for seating in one of a series of lock holes located along said longitudinally-extending base beam for locking said body support beam in a desired vertical or off-vertical orientation with respect to said base beam.

4. An exercise machine for the strengthening and development of shoulder muscles as claimed in claim 1 wherein the adjustable height seat on said body support beam is mounted to said beam by a slidable seat height adjustment member which includes a pull-type lock pin which is spring biased for seating in one of a series of lock holes along said body support beam for locking said height adjustment member and said seat at a desired height on said beam.

5. An exercise machine for the strengthening and development of shoulder muscles as claimed in claim 4 wherein the adjustable height seat includes a seat frame which is pivotally mounted at its rear portion to the slidable seat height adjustment member and said seat frame is provided with an adjustable-length seat prop arm which is pivoted at its forward end to the forward portion of said frame and pivoted at its rear end to the slidable seat height adjustment member at a point below the point at which said frame is pivotally mounted at its rear portion to said height adjustment member whereby said adjustable-length prop arm comprises means for adjusting the orientation of said seat with respect to said body support beam.

6. An exercise machine for the strengthening and development of shoulder muscles as claimed in claim 5 wherein said adjustable-length seat prop arm includes a main body portion at its rear end and a telescoping arm portion at its forward end, said telescoping portion being pivoted to the forward portion of said seat frame, and said prop arm includes a pull-type lock pin which is spring biased for seating in one of a series of lock holes located along said telescoping arm portion for locking said telescoping arm portion in a desired position with respect to the main body portion of said prop arm.

7. An exercise machine for the strengthening and development of shoulder muscles as claimed in claim 1 wherein the centrally-disposed, extensible-length body support beam has affixed thereto, above the adjustable height seat, a back rest and head support member for the exercising person.

8. An exercise machine for the strengthening and development of shoulder muscles as claimed in claim 1 wherein the supporting frame of each arm abutment member includes an extensible-length pivot arm journaled to the respective journal box affixed to the upper end of said body support beam whereby the position of said abutment member may be adjusted inwardly or outwardly from the body of the exercising person.

9. An exercise machine for the strengthening and development of shoulder muscles as claimed in claim 8 wherein the extensible-length pivot arm is comprised of a main pivot arm member and a telescoping pivot arm extension member and said pivot arm is provided with means for locking said telescoping extension member with respect to the main pivot arm member after appropriate adjustment of the arm abutment member inwardly or outwardly from the body of the exercising person.

10. An exercise machine for the strengthening and development of shoulder muscles as claimed in claim 1 wherein the weight means carried by the supporting frame of each arm abutment member is provided with means for locking said weight means with respect to its adjustable position on said frame whereby the variable resistive force established by said weight means as applied through said frame and said abutment member is related directly to the distance of said weight means from the pivot point of said frame multiplied by the weight of said weight means.

11. An exercise machine for strengthening and developing the shoulder muscles of an exercising person comprising:

(a) a structural frame including a longitudinally-extending base beam and an upper pair of horizontally-projecting support arms each terminating in a journal box;

(b) an extensible centrally-disposed upright body support beam affixed to said structural frame by pivotal connection at its upper end to the journal box of each horizontally-projecting support arm and by adjustable coupling at its lower end to said base beam to provide vertical or off-vertical orientation to said body, support beam;

(c) an adjustable height seat on said body support beam adapted to support an exercising person in a sitting position;

(d) right side and left side arm abutment members positioned for engagement by the outer portion of the forearms, in horizontal orientation, of the exercising person, each of said abutment members being affixed to a respective supporting frame journaled to a respective journal box affixed to the upper end of said body support beam located at a point above a respective shoulder of the exercising person whereby each of said arm abutment members may be rotated outwardly and upwardly by movement of the upper arms of said exercising person; and (e) weight means carried by the supporting frame of each abutment member at the rearward end thereof and adjustably positionable on said frame with respect to its pivot point at its respective journal box whereby a variable resistive force for strengthening and developing shoulder muscles is applied through said frame and said abutment member to the outer portion of the forearm of said exercising person in opposition to rotative movement of the upper arm of said person in an outward and upward direction.

12. An exercise machine for strengthening and developing the shoulder muscles of an exercising person as claimed in claim 11 wherein handgrip means are carried by the supporting frame of each arm abutment member at the forward end of said frame and positioned for grasping engagement by the hands of the exercising person.

13. An exercise machine for strengthening and developing the shoulder muscles of an exercising person as claimed in claim 11 wherein the supporting frame of each arm abutment member includes an extensible-length pivot arm journaled to a respective journal box affixed to the upper end of said body support beam whereby the position of said abutment member may be adjusted inwardly or outwardly from the body of the exercising person.

14. An exercise machine for strengthening and developing the shoulder muscles of an exercising person as claimed in claim 13 wherein the extensible-length pivot arm is comprised of a main pivot arm member and a telescoping pivot arm extension member and said pivot arm is provided with means for locking said telescoping extension member with respect to the main pivot arm member after appropriate adjustment of the arm abutment member inwardly or outwardly from the body of the exercising person.

* * * * *